US005644861A

United States Patent [19]

Knight

[11] Patent Number: 5,644,861

[45] Date of Patent: Jul. 8, 1997

[54] FIRING MECHANISM FOR MUZZLELOADING RIFLES

[75] Inventor: William A. Knight, Centerville, Iowa

[73] Assignee: Modern Muzzleloading, Inc., Centerville, Iowa

[21] Appl. No.: 532,521

[22] Filed: Sep. 22, 1995

[51] Int. Cl.[6] ..... F41C 7/00

[52] U.S. Cl. ..... 42/51; 42/65; 42/69.01; 42/41; 42/69.02; 42/83

[58] Field of Search ..... 42/51, 65, 69.01, 42/41, 69.02, 83; 89/1.3

[56] References Cited

U.S. PATENT DOCUMENTS

| | | | |
|---|---|---|---|
| 3,780,464 | 12/1973 | Anderson | 42/69 R |
| 4,114,303 | 9/1978 | Vaughn | 42/51 |
| 4,123,867 | 11/1978 | Peterson | 42/83 |
| 4,135,321 | 1/1979 | Lewallyn | 42/83 |
| 4,700,499 | 10/1987 | Knight | 42/51 |
| 5,133,143 | 7/1992 | Knight | 42/51 |
| 5,148,620 | 9/1992 | Nelson | 42/77 |
| 5,408,776 | 4/1995 | Mahn et al. | 42/51 |
| 5,467,551 | 11/1995 | Kruse | 42/83 |
| 5,487,232 | 1/1996 | Osborne et al. | 42/51 |

*Primary Examiner*—Charles T. Jordan
*Assistant Examiner*—Meena Chelliah
*Attorney, Agent, or Firm*—Zarley, McKee, Thomte, Voorhees & Sease

[57] ABSTRACT

A firing mechanism for a muzzleloading rifle has a stock, a rifle barrel, a breech plug in the rearward end of said breech plug, a receiver on the stock, a bolt and hammer assembly in the receiver rearwardly of the nipple, and a trigger assembly operatively secured to the bolt and hammer assembly. An adapter element is mounted on the rearward end of the nipple and has a rearward end with an opening therein for receiving and holding a cap rifle primer. The bolt and hammer assembly has a hammer with a forward end in axial alignment with the adapter element, the forward end of the hammer terminating in a forwardly extending conical shaped firing surface to engage a rifle primer mounted within the opening at the rearward end of the adapter element.

15 Claims, 3 Drawing Sheets

FIRING MECHANISM FOR MUZZLELOADING RIFLES

BACKGROUND OF THE INVENTION

Muzzleloading rifles typically use a percussion cap to effect firing. Percussion caps are inferior to conventional rifle primers which give superior ignition, a hotter ignition, and which are cleaner and more consistent. The hotter the ignition, the more velocity is transmitted to the projectile.

In the firearm industry, the terms "percussion caps" and "rifle primers" are well known and understood by those involved in that industry.

A percussion cap is a cup-shaped, formed piece of thin, soft metal with a thin coating of priming compound on the inside of the flat surface of the closed portion of the cup. For the priming compound to ignite, it must be compressed between two surfaces. The percussion cap is placed on the nipple, which acts as an anvil, so that when the hammer strikes the cap, the priming compound is compressed between the hammer and the nipple, setting off the priming compound. The percussion cap is used in virtually all non-flintlock muzzleloading rifles.

A rifle primer is similar in size and shape to the percussion cap, but contains significantly more priming compound. The rifle primer has an integral anvil, normally eliminating the need for a nipple. When the hammer strikes the rifle primer, the priming compound is compressed between the hammer and the integral anvil, setting off the priming compound.

It is therefore a principal object of this invention to provide a muzzleloading rifle which can utilize a rifle primer for firing rather than a conventional percussion cap.

A further object of this invention is to provide a muzzleloading rifle with components to use a rifle primer which can be easily and quickly installed in a conventional muzzleloading rifle.

A still further object of this invention is to provide a hammer for a muzzleloading rifle which is tapered to better ignite the rifle primer and which overcomes a problem with conventional firing pins which might penetrate the primer without igniting it.

These and other objects will be apparent to those skilled in the art.

BRIEF SUMMARY OF THE INVENTION

Conventional muzzleloading rifles have a breech plug at the rearward end of the rifle barrel. A conventional nipple is threaded into the rearward end of the breech plug and protrudes rearwardly into the receiver. A conventional percussion cap is placed on the rearward end of the nipple and is selectively ignited through the impact of the flat surface of the rifle hammer.

This invention eliminates the percussion cap. Instead, an adapter element is placed on the rearward end of the nipple in place of the conventional percussion cap. The adapter element has a rearward opening that is compatible in shape to a conventional rifle primer which is received therein. The hammer of the rifle has a tapered and forwardly extending conical surface terminating in a point which can selectively strike the rifle primer for ignition.

DESCRIPTION OF THE PREFERRED EMBODIMENT

Figure 1:
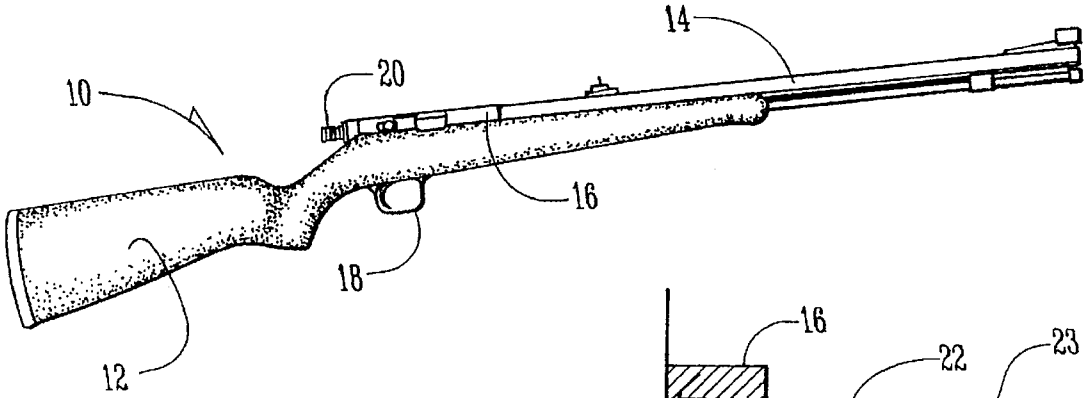
FIG. 1 is a side elevational view of a conventional muzzleloading rifle.
Figure 2:
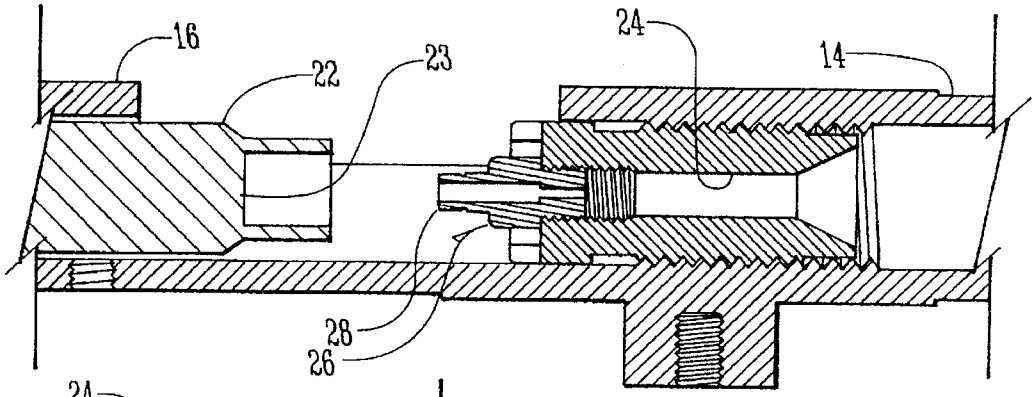
FIG. 2 is a partial section view of the rifle of FIG. 1 with the bolt and hammer assembly in a retracted position.

FIG. 1 is a side elevational view of a conventional muzzleloading rifle 10, which has a stock 12, a barrel 14, a receiver 16, a trigger assembly 18, a bolt and hammer assembly 20, a hammer 22 (FIG. 2) with a flat firing surface 23, a breech plug 24 (FIG. 2) with a conventional nipple 26 threaded into the rearward end of the breech plug. The rearward end of the nipple terminates in a conventional hollow shoulder 28. The above described structure is conventional.

Figure 4:
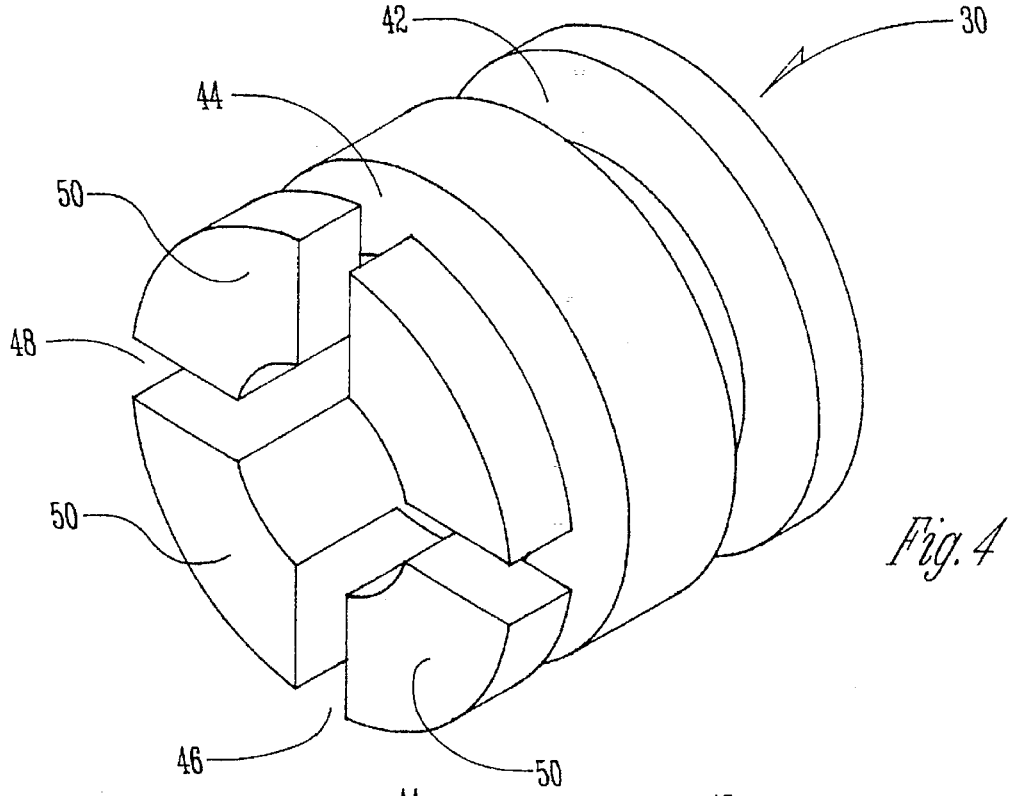
FIG. 4 is a large scale perspective view of the adapter element of this invention.

This invention contemplates the use of an adapter element 30 (FIGS. 4 and 5) which has a forward end 32, a rearward end 34, a forward bore 36, and a rearward bore or opening 38. The bores 36 and 38 are separated by shoulder 40, as best shown in FIG. 5.

Figure 3:
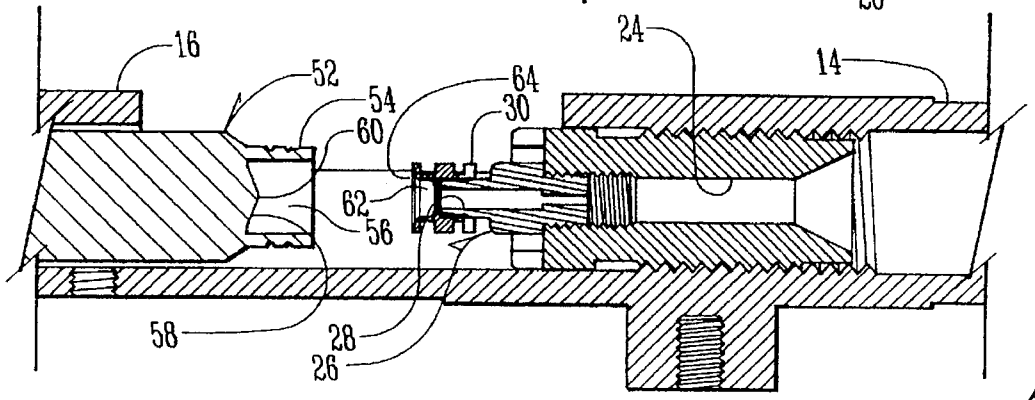
FIG. 3 is a view similar to FIG. 2 except that the adapter and modified bolt and hammer assembly of this invention are shown.

A pair of annular grooves 42 and 44 appear concentrically on the outer surface of adapter element 30. Intersecting vertical slot 46 and horizontal slot 48 are cut in the forward end of adapter element 30 and intersect annular groove 44. The slots 46 and 48 form deformable sections 50. The adapter element 30 is fitted on the shoulder 28 of nipple 26 as shown in FIG. 3. The deformable sections 50 can be crimped inwardly against the shoulder 28 to affix the adapter element 30 to the nipple.

Figure 6:
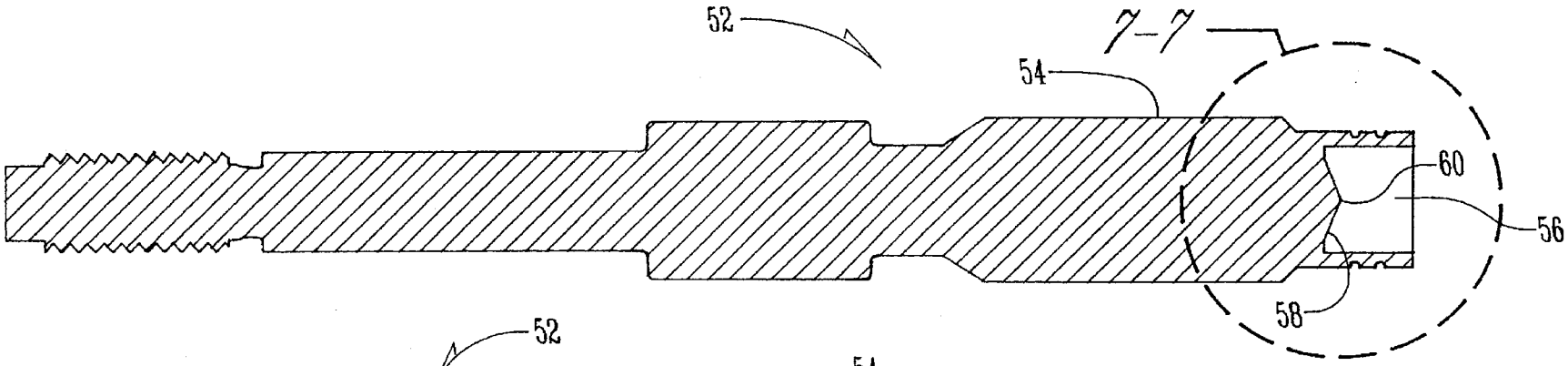
FIG. 6 is an enlarged scale sectional view through the modified bolt and hammer assembly of this invention.
Figure 7:
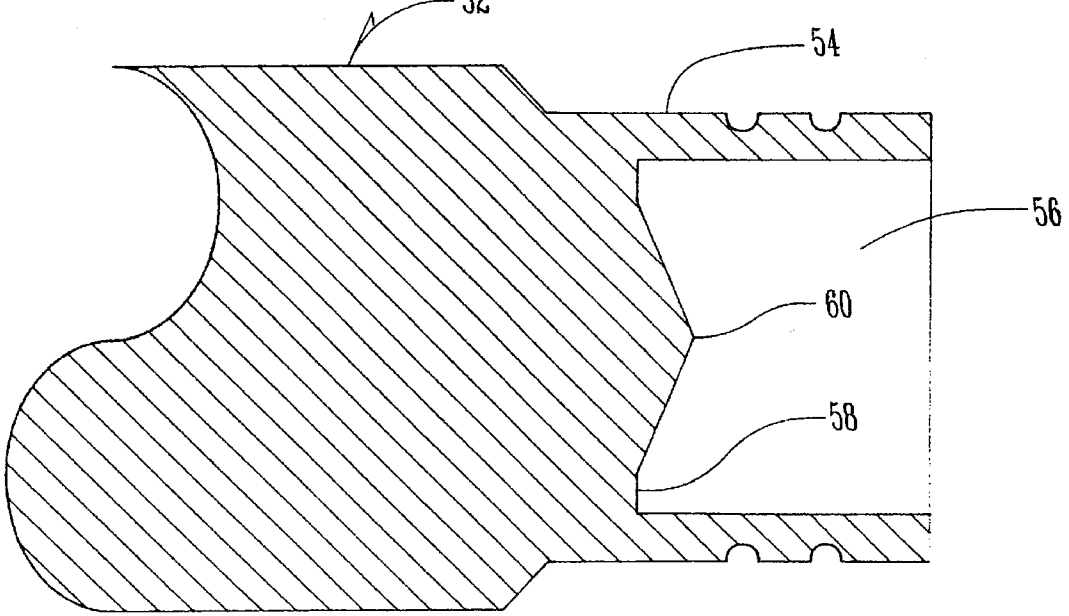
FIG. 7 is an enlarged scale partial sectional view taken on line 7—7 of FIG. 6.

The conventional bolt and hammer assembly is removed from the rifle 10 and a modified bolt and hammer assembly 52 (FIGS. 3, 6 and 7) is used in lieu thereof. Bolt and hammer assembly 52 has a hammer 54 with a well 56 therein. A tapered conical firing surface 58 is concentrically located in well 56 and terminates in a forwardly extending point 60.

Figure 5:
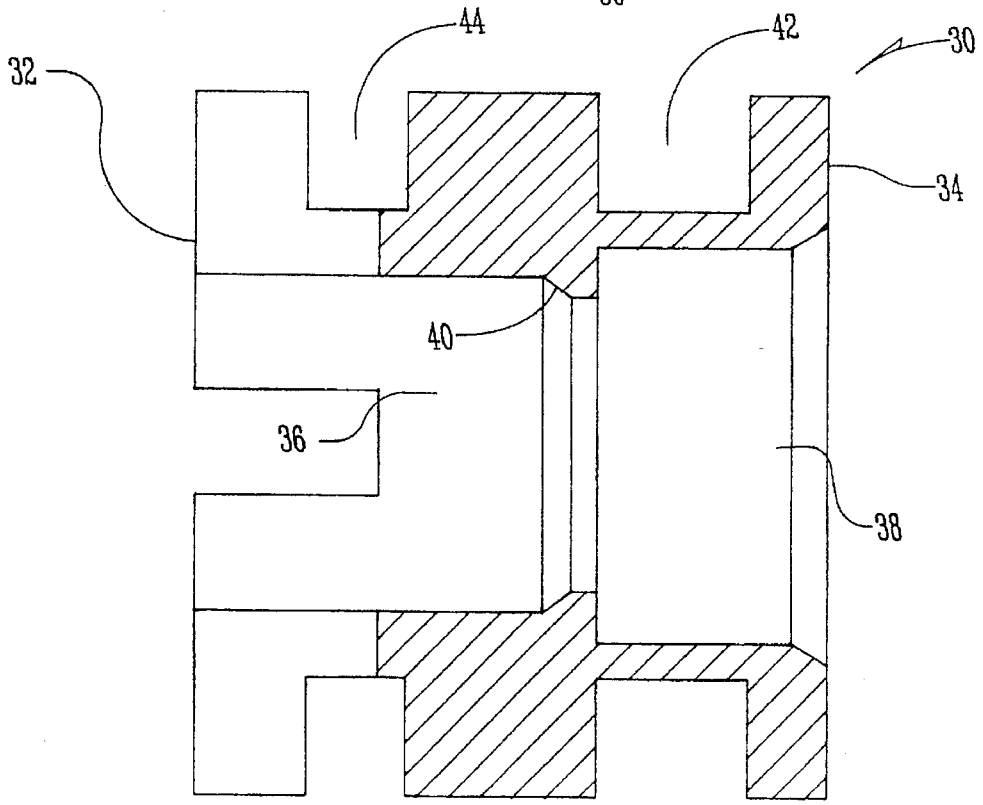
FIG. 5 is an enlarged scale sectional view taken on the longitudinal axis of the adapter element of FIG. 4.

A conventional rifle primer 62 having a rearward flange 64 is complementary in shape and fits directly into the opening 38 at the rearward end 34 of adapter element 30 (see FIGS. 3 and 5). Typically, a plurality of primers are loaded into the adapters beforehand and are carried by the hunter.

The modified bolt and hammer assembly 52 is placed in the receiver 16 in place of the conventional bolt and hammer assembly 20. When the bolt and hammer assembly 52 is in its retracted position (FIG. 3) and with the use of suitable tools, the preloaded adapter element is placed on the rearward end of the nipple 26. When the trigger assembly 18 is conventionally actuated, the hammer 54 moves forwardly and the point 60 on the conical surface 58 engages the rifle primer 62 and causes it to ignite.

The modified hammer 54, because of the conical surface 58 at point 60 is sure to ignite the rifle primer 62. Hammer 54 is also superior to the use of a conventional firing pin because the firing pin might penetrate the primer without igniting it.

It is therefore seen that the conventional muzzleloading rifle 10 can be easily converted to use rifle primers by the addition of the adapter element 30 along with the modified hammer 54. As a result, the resulting rifle gives superior ignition, a hotter ignition, a cleaner ignition, and is more consistent. Through the use of the hotter ignition, more velocity is transmitted to the ball or slug used by the rifle 10. The modification of the existing rifle 10 can be quickly and easily accomplished.

It is therefore seen that the device of this invention will accomplish at least its stated objectives.

What is claimed is:

1. A firing mechanism for a muzzleloading rifle having a stock, a rifle barrel, a breech plug in the rearward end of said barrel, a receiver on said stock, a bolt and hammer assembly in said receiver rearwardly of said breech plug, and a trigger assembly operatively secured to said bolt and hammer assembly, the firing mechanism comprising, a nipple secured to said rearward end of said breech plug, said nipple having an enlarged central portion and a reduced outer diameter rearward end, an adapter element mounted on said reduced outer diameter rearward end of said nipple and having a rearward end, and a rifle primer mounted on the rearward end of said adapter element.

2. The device of claim 1 wherein said nipple has a rearwardly extending cylindrically shaped shoulder, said adapter having a forward axial bore communicating with an opening on the rearward end of said adapter, said shoulder on said nipple being received within said forward axial bore of said adapter.

3. The device of claim 2 wherein an annular shoulder is located between said forward axial bore and said opening to limit the penetration of said shoulder of said nipple into said adapter.

4. The device of claim 1 wherein said adapter element has some deformable sections on the forward end thereof to permit said adapter element to be in tight engagement with said nipple.

5. The device of claim 1 wherein said bolt and hammer assembly has a hammer with a forward end in axial alignment with said adapter element, the forward end of said hammer terminating in a forwardly extending conical shaped firing surface to engage a rifle primer mounted within said opening at the rearward end of said adapter element.

6. The device of claim 5 wherein said firing surface is positioned with a hollow well in the forward end of said hammer.

7. The device of claim 1 wherein said rifle primer is held within an opening in the rearward end of said adapter element.

8. A firing mechanism for a muzzleloading rifle having a stock, a rifle barrel, a breech plug in the rearward end of said barrel, a receiver on said stock, a bolt and hammer assembly in said receiver rearwardly of said breech plug, and a trigger assembly operatively secured to said bolt and hammer assembly, the firing mechanism comprising, a nipple secured to the rearward end of said breech plug, said nipple having an enlarged central portion and a reduced outer diameter rearward end, an adapter element mounted on said reduced outer diameter rearward end of said nipple and having a rearward end, a primer mounted on said rearward end of said adapter element, said bolt and hammer assembly having a hammer with a forward end in axial alignment with said adapter element, the forward end of said hammer terminating in a forwardly extending conical-shaped firing surface to engage a rifle primer mounted within said opening at the rearward end of said adapter element.

9. The device of claim 8 wherein said firing surface is positioned within a hollow well in the forward end of said hammer.

10. A firing mechanism for a muzzleloading rifle having a stock, a rifle barrel, a breech plug in the rearward end of said barrel, a nipple secured to the rearward end of said breech plug, a receiver on said stock, a bolt and hammer assembly in said receiver rearwardly of said nipple, and a trigger assembly operatively secured to said bolt and hammer assembly, the firing mechanism comprising, an adapter element mounted on the rearward end of said nipple and having a rearward end, and a rifle primer mounted on the rearward end of said adapter element, said nipple having a rearwardly extending cylindrically shaped shoulder, said adapter having a forward axial bore communicating with an opening on the rearward end of said adapter, said shoulder on said nipple being received within said forward axial bore of said adapter, said opening at the rearward end of said adapter having a diameter greater than the diameter of said forward axial bore.

11. A firing mechanism for a muzzleloading rifle having a stock, a rifle barrel, a breech plug in the rearward end of said barrel, a nipple secured to the rearward end of said breech plug, a receiver on said stock, a bolt and hammer assembly in said receiver rearwardly of said nipple, and a trigger assembly operatively secured to said bolt and hammer assembly, the firing mechanism comprising, an adapter element mounted on the rearward end of said nipple and having a rearward end, and a rifle primer mounted on the rearward end of said adapter element;

having deformable sections being former: by an annular groove adjacent the forward end of having adapter element intersecting at least one transverse slot.

12. The device of claim 11 wherein said adapter is comprises of a malleable metal having the physical properties of brass.

13. The device of claim 11 wherein said adapter is comprised of brass.

14. A firing mechanism for a muzzleloading rifle having a stock, a rifle barrel, a breech plug in the rearward end of said barrel, a nipple secured to the rearward end of said breech plug, a receiver on said stock, a bolt and hammer assembly in said receiver rearwardly of said nipple, and a trigger assembly operatively secured to said bolt and hammer assembly, the invention comprising, an adapter element mounted on the rearward end of said nipple and having a rearward end, and a rifle primer mounted on the rearward end of said adapter element, having deformable sections being formed by an annular groove adjacent the forward end of said adapter element intersecting a pair of intersecting transverse slots.

15. The firing mechanism of claim 1 wherein said adapter element has said rifle primer press fitted therein to form a preloaded adapter assembly which is detachably mounted on said rearward end of said nipple such that said adapter element can have said rifle primer preloaded therein and be installed on said nipple and removed therefrom without tools or disassembly of said rifle.

* * * * *

UNITED STATES PATENT AND TRADEMARK OFFICE

CERTIFICATE OF CORRECTION

PATENT NO. : 5,644,861

DATED : July 8, 1997

INVENTOR(S) : William A. Knight

It is certified that error appears in the above—identified patent and that said Letters Patent is hereby corrected as shown below:

In column 4, lines 47 and 48 should read:

having deformable sections being formed by an annular groove adjacent the forward end of said adapter Signed and Sealed this Second Day of September, 1997

*Attest:*

Bruce Lehman

BRUCE LEHMAN

*Attesting Officer*

*Commissioner of Patents and Trademarks*